United States Patent [19]

Kunda

[11] 4,306,902

[45] Dec. 22, 1981

[54] PROCESS FOR THE PRODUCTION OF ELEMENTAL SILVER FROM SILVER CHLORIDE OR SILVER SULPHATE

[75] Inventor: Wasyl Kunda, Edmonton, Canada

[73] Assignee: Sherritt Gordon Mines Limited, Toronto, Canada

[21] Appl. No.: 179,603

[22] Filed: Aug. 19, 1980

[30] Foreign Application Priority Data

May 30, 1980 [CA] Canada ..... 353084

[51] Int. Cl.[3] ..... B22F 9/00; C22B 11/00

[52] U.S. Cl. ..... 75/0.5 B; 75/83

[58] Field of Search ..... 75/83, 0.5 B

[56] References Cited

U.S. PATENT DOCUMENTS 3,929,466 12/1975 Moynahan et al. ..... 75/83

*Primary Examiner*—M. J. Andrews

*Attorney, Agent, or Firm*—Robert F. Delbridge; Arne I. Fors

[57] ABSTRACT

A process for the production of elemental silver from silver chloride or silver sulphate includes mixing the silver salt with sodium carbonate, and heating the mixture at a temperature in the range of from about 500° C. to about 650° C. to produce elemental silver powder.

5 Claims, No Drawings

PROCESS FOR THE PRODUCTION OF ELEMENTAL SILVER FROM SILVER CHLORIDE OR SILVER SULPHATE

This invention relates to the production of elemental silver from silver chloride or silver sulphate.

In the hydrometallurgical treatment of silver-containing materials, silver chloride or silver sulphate are frequently produced. Known methods for the production of elemental silver from these salts have various disadvantages. One known method is to heat silver chloride with metallic zinc powder, but metallic zinc powder is expensive and the silver product is unduly contaminated with zinc. Further, a temperature of about 1100° C. is required for this reaction, and at this temperature the reduced metallic silver tends to react with a ceramic or metallic reaction vessel, thereby further contaminating the silver.

It has also been proposed to reduce an aqueous suspension of silver chloride in the presence of metallic zinc powder or silver ammine sulphate solution with hydrogen gas. However, the hydrogen reagent is also relatively expensive and the reaction has to be carried out under pressure in an autoclave.

It is therefore an object of the invention to provide an improved process for the recovery of elemental silver from silver chloride or silver sulphate.

The present invention is based on the discovery that elemental silver in the form of fine powder can be produced by mixing silver chloride or silver sulphate with sodium carbonate, and heating the mixture at a temperature in the range of from about 500° C. to about 650° C. to effect a solid state reaction. The reaction is usually complete relatively quickly, for example in about one hour, and the silver powder produced does not significantly react with a ceramic or suitable metallic reaction vessel. Sodium chloride or sodium sulphate is also produced in the reaction and, together with any unreacted sodium carbonate, may readily be removed by washing with water. The other reaction products are carbon dioxide and oxygen which are of course harmless gases. The silver product is usually directly obtained as a fine powder. Some slight sintering may occur at a temperature above about 625° C., but this can readily be broken up.

In the case of silver chloride, the mixture is preferably heated at a temperature over about 570° C. to ensure completeness of the reaction and below about 625° C. to lessen the likelihood of sintering. In the case of silver sulphate, the reaction does take place substantially at a lower temperature than in the case of silver chloride, and thus the temperature range of from about 500° C. to about 550° C. is preferred in the case of silver sulphate.

Stoichiometrically, it would have been expected that about one-half mole of sodium carbonate would have been required for each mole of silver chloride, in accordance with the following reaction:

$$2AgCl + Na_2CO_3 \rightarrow 2Ag + 2NaCl + CO_2 + \tfrac{1}{2}O_2$$

However, it has been found that about one mole of sodium carbonate, i.e. 100% stoichiometric excess, per mole of silver chloride should be provided to ensure completeness of reaction.

In the case of silver sulphate, it would have been expected that about one mole of sodium carbonate would be required for each mole of silver sulphate in accordance with the following reaction:

$$Ag_2SO_4 + Na_2CO_3 \rightarrow 2Ag + Na_2SO_4 + CO_2 + \tfrac{1}{2}O_2$$

Again it has been found that about 100% excess of sodium carbonate should be provided to ensure completeness of reaction, that is to say there should be about two moles of sodium carbonate per mole of silver sulphate.

What I claim as new and desire to protect by Letters Patent of the United States is:

1. A process for the production of elemental silver from a silver salt selected from the group consisting of silver chloride and silver sulphate, said process comprising mixing the silver salt with sodium carbonate, and heating the mixture at a temperature in the range of from about 500° C. to about 650° C. to produce a product mixture comprising elemental silver powder and a product sodium salt selected from the group consisting of sodium chloride and sodium sulphate, cooling the product mixture, and removing the product sodium salt and any unreacted sodium carbonate from the elemental silver powder by washing with water.

2. A process according to claim 1 wherein the silver salt is silver chloride, and the mixture is heated at a temperature in the range of from about 570° C. to about 625° C. to produce elemental silver powder.

3. A process according to claim 1 wherein the silver salt is silver chloride, and the silver chloride and sodium carbonate are mixed in the proportion of about 1 mole of sodium carbonate per mole of silver chloride.

4. A process according to claim 1 wherein the silver salt is silver sulphate, and the mixture is heated at a temperature in the range of from about 500° C. to about 550° C. to produce elemental silver powder.

5. A process according to claim 1 wherein the silver salt is silver sulphate, and the silver sulphate and sodium carbonate are mixed in the proportions of about two moles of sodium carbonate per mole of silver sulphate.

* * * * *